US011286429B2

(12) United States Patent
Fathi et al.

(10) Patent No.: US 11,286,429 B2
(45) Date of Patent: Mar. 29, 2022

(54) PROCESS FOR HEAVY OIL UPGRADING UTILIZING HYDROGEN AND WATER

(71) Applicant: SAUDI ARABIAN OIL COMPANY, Dhahran (SA)

(72) Inventors: Mazin M. Fathi, Dhahran (SA); Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/911,827

(22) Filed: Jun. 25, 2020

(65) Prior Publication Data

US 2021/0403817 A1 Dec. 30, 2021

(51) Int. Cl.

| | |
|---|---|
| ***C10G 47/26*** | (2006.01) |
| ***C10G 67/14*** | (2006.01) |
| ***C10G 21/14*** | (2006.01) |
| ***C10G 21/28*** | (2006.01) |
| ***C10G 25/12*** | (2006.01) |
| ***C10G 45/16*** | (2006.01) |
| ***C10G 45/26*** | (2006.01) |
| ***C10G 21/00*** | (2006.01) |

(52) U.S. Cl.

CPC ..... *C10G 47/26* (2013.01); *C10G 21/003* (2013.01); *C10G 21/14* (2013.01); *C10G 21/28* (2013.01); *C10G 25/12* (2013.01); *C10G 45/16* (2013.01); *C10G 45/26* (2013.01); *C10G 67/14* (2013.01); *C10G 2300/107* (2013.01); *C10G 2300/1077* (2013.01); *C10G 2300/206* (2013.01); *C10G 2300/4006* (2013.01); *C10G 2300/4012* (2013.01); *C10G 2300/703* (2013.01); *C10G 2300/802* (2013.01); *C10G 2300/805* (2013.01)

(58) Field of Classification Search

CPC .... C10G 31/08; C10G 47/26; C10G 67/0454; C10G 67/06; C10G 67/14

See application file for complete search history.

(56) References Cited

U.S. PATENT DOCUMENTS

| | | | | |
|---|---|---|---|---|
| 3,240,718 | A | 3/1966 | Gatsis | |
| 5,688,741 | A | 11/1997 | Carrazza et al. | |
| 5,885,441 | A | 3/1999 | Pereira et al. | |
| 7,566,394 | B2 * | 7/2009 | Koseoglu ..... | C10G 21/003 208/309 |

(Continued)

FOREIGN PATENT DOCUMENTS

EP 0171460 A1 2/1986

OTHER PUBLICATIONS

Fathi M., Pereira-Almao P., "Catalytic Aquaprocessing of Arab Light Vacuum Residue via Short Space Times," Energy Fuels, 2011, 25 (11), pp. 4867-4877.

(Continued)

*Primary Examiner* — Renee Robinson
(74) *Attorney, Agent, or Firm* — Leason Ellis LLP

(57) ABSTRACT

A process for upgrading heavy oil is provided, which integrates thermal cracking, hydrogenolysis, and catalytic aquathermolysis. A catalytic hydrogen-aquathermolysis reactor receives a heavy oil feed, water and hydrogen. In addition catalytic materials and a viscosity reducing agent are introduced. The catalytic hydrogen-aquathermolysis reactor is operated at conditions effective to produce an upgraded heavy oil product.

26 Claims, 5 Drawing Sheets

(56) References Cited

U.S. PATENT DOCUMENTS

| | | | | |
|---|---|---|---|---|
| 8,585,891 | B2 | 11/2013 | Lourenco et al. | |
| 2008/0099376 | A1 | 5/2008 | He et al. | |
| 2009/0159498 | A1 | 6/2009 | Chinn et al. | |
| 2009/0166261 | A1 | 7/2009 | Li et al. | |
| 2011/0005970 | A1 | 1/2011 | Ou et al. | |
| 2011/0210045 | A1* | 9/2011 | Kou | C10G 65/02 208/59 |
| 2012/0270957 | A1 | 10/2012 | Kresnyak | |
| 2013/0015100 | A1 | 1/2013 | Pereira et al. | |
| 2013/0026067 | A1 | 1/2013 | Koseoglu | |
| 2015/0144527 | A1* | 5/2015 | Fathi | C10G 65/12 208/57 |
| 2017/0029720 | A1* | 2/2017 | Koseoglu | C10G 25/12 |
| 2018/0258353 | A1* | 9/2018 | Choi | C10G 65/12 |
| 2020/0157440 | A1 | 5/2020 | Koseoglu | |

OTHER PUBLICATIONS

Fathi, M. M. Comparative Upgrading of Arab Light Vacuum Residuum via Aquaprocessing and Thermal Cracking. Dissertation, University of Calgary, Calgary, 2011.

Fathi M. Fathi, Pereira-Almao P, "Kinetic Modeling of Arab Light Vacuum Residue Upgrading by Aquaprocessing at High Space Velocities," Ind. Eng. Chem. Res., 2013, 52 (2), pp. 612-623.

N. N. Petrukhina, B. P. Tumanyan, I. M. Kolesnikov, "Thermodynamic Parameters of Conversion Reactions of Some Heavy Oil Components Under the Action of Steam and Heat," Chemistry and Technology of Fuels and Oils, Sep. 2012, vol. 48, Issue 4, pp. 292-301 (abstract).

PCT International Search Report and Written Opinion from corresponding PCT Application No. PCT/US2021/038359 dated Sep. 20, 2021.

* cited by examiner

PROCESS FOR HEAVY OIL UPGRADING UTILIZING HYDROGEN AND WATER

RELATED APPLICATIONS

Not applicable.

BACKGROUND

Field of the Invention

This invention relates to thermal cracking of heavy oil feedstocks.

Description of Related Art

Residual and heavy hydrocarbon oils contain heteroatoms, heavy aromatic molecules, and asphaltenes that adversely impact the ability to upgrade these materials. Asphaltenes are present in crude oil and their heavy fractions in varying quantities, depending on various factors including, but not limited to the source of the crude and the age of the producing well.

Asphaltenes are brown to black powdery, n-paraffin insoluble compounds rich in polynuclear aromatic compounds. They contain heteroatoms such as nitrogen, sulfur, and oxygen, and are soluble in carbon disulfide and aromatic solvents such as toluene and benzene. Their tendency to precipitate is determined by adding a specific quantity of selected n-paraffin to a heavy oil fraction.

Asphaltenes and polyaromatics are present in the petroleum products discussed supra, and are generated in the oil mixture during any upgrading process. They are dispersed in the oil medium and are solvated through alkyl appendages which cross-link to different species present in the oil, including clusters of polyaromatic rings and naphthenes. During upgrading, thermal energy breaks the cross linkages, which allows the asphaltenes molecules to move freely in the oil medium. These free asphaltenes molecules approach each other and combine to form larger aggregates. These aggregates associate with each other and form layers of aggregates through mechanisms, which include free radicals recombination reactions and polar-polar interactions. These layers result in coke formation and deposition during heavy oil upgrading processes.

Current state of the art for upgrading heavy oils include the thermal cracking, delayed coking, hydrotreating followed by residue fluidized catalytic cracking, hydrocracking, catalytic steam conversion, slurry cracking and aquathermolysis. Existing art is disclosed with reference to the names: Supercritical water process (SCW); Aquaconversion® (AQC) developed by Intevep, UOP and Foster Wheeler; Super Oil Cracking (SOC), developed by Asahi, Nippon Mining Co. and Chiyoda Chemical Engineering and Construction Co., Ltd.; Eni Slurry Technology (EST) developed by Eni (Italy); and disclosed with reference to U.S. Pat. Nos. 5,885,441, 3,240,718, U.S. Patent Application 2008/0099376, U.S. Patent Application 2009/0159498, U.S. Patent Application 2009/0166261; and in Fathi M., Pereira-Almao P. (2011) Catalytic Aquaprocessing of Arab Light Vacuum Residue via Short Space Times, *Energy & Fuel*, 25: 4867-4877.

Despite the state of the art processes for upgrading heavy petroleum oils, there remains a need in the industry for alternative processes with improved efficiencies.

SUMMARY OF THE DISCLOSURE

A heavy oil upgrading process is disclosed that integrates thermal cracking, hydrogenolysis, and catalytic aquathermolysis. The process is operated at low to moderate operating conditions. The inclusion of a low quantity of hydrogen, water, and highly dispersed catalytic particles in the heavy oil improves conversion and minimizes asphaltenes generation and aggregation. In addition, due to the presence of hydrogen and moderate operating pressures, catalytic hydrotreating also occurs.

The upgrading process combines thermal cracking, hydrogenolysis, and catalytic aquathermolysis in a single unit operation. Catalytic material is provided in the form of highly dispersed catalyst particles, and the operating conditions include relatively low pressure. This integration of thermal cracking, hydrogenolysis, and catalytic aquathermolysis represents an advance in the industry and provides enhanced commercial value by meeting fuel oil demand, increasing gain on oil output, improving refining economics, and improving heavy oil properties for subsequent upgrading or refining processes.

In further embodiments, a solvent deasphalting process is integrated downstream of the combined thermal cracking, hydrogenolysis, and catalytic aquathermolysis unit operation.

The catalytic hydrogen-aquathermolysis process herein advantageously enhances heavy oil upgrading using low-pressure hydrogen, water and catalytic particles, injected and/or otherwise intimately mixed, with the heavy hydrocarbon feed. The mixture is maintained at relatively moderate pressure levels and relatively high temperature levels. Coke and asphaltene production is reduced through improved water self-dissociation and catalytic splitting through radical mechanisms. In addition, hydrogen addition promotes saturation of free hydrocarbon radicals, and suppresses hydrogen abstraction reactions. As noted above, in certain embodiments, the upgraded heavy oil is subjected to solvent deasphalting, where at least a portion of catalyst particles are removed with the asphalt phase. Further, in certain embodiments multiple upgrading cycles are employed to maximize heavy oil conversion and minimize by-products.

BRIEF DESCRIPTION OF THE DRAWINGS

The disclosed process and system will be described in further detail below and with reference to the attached drawings, in which.

DETAILED DESCRIPTION

Figure 1:
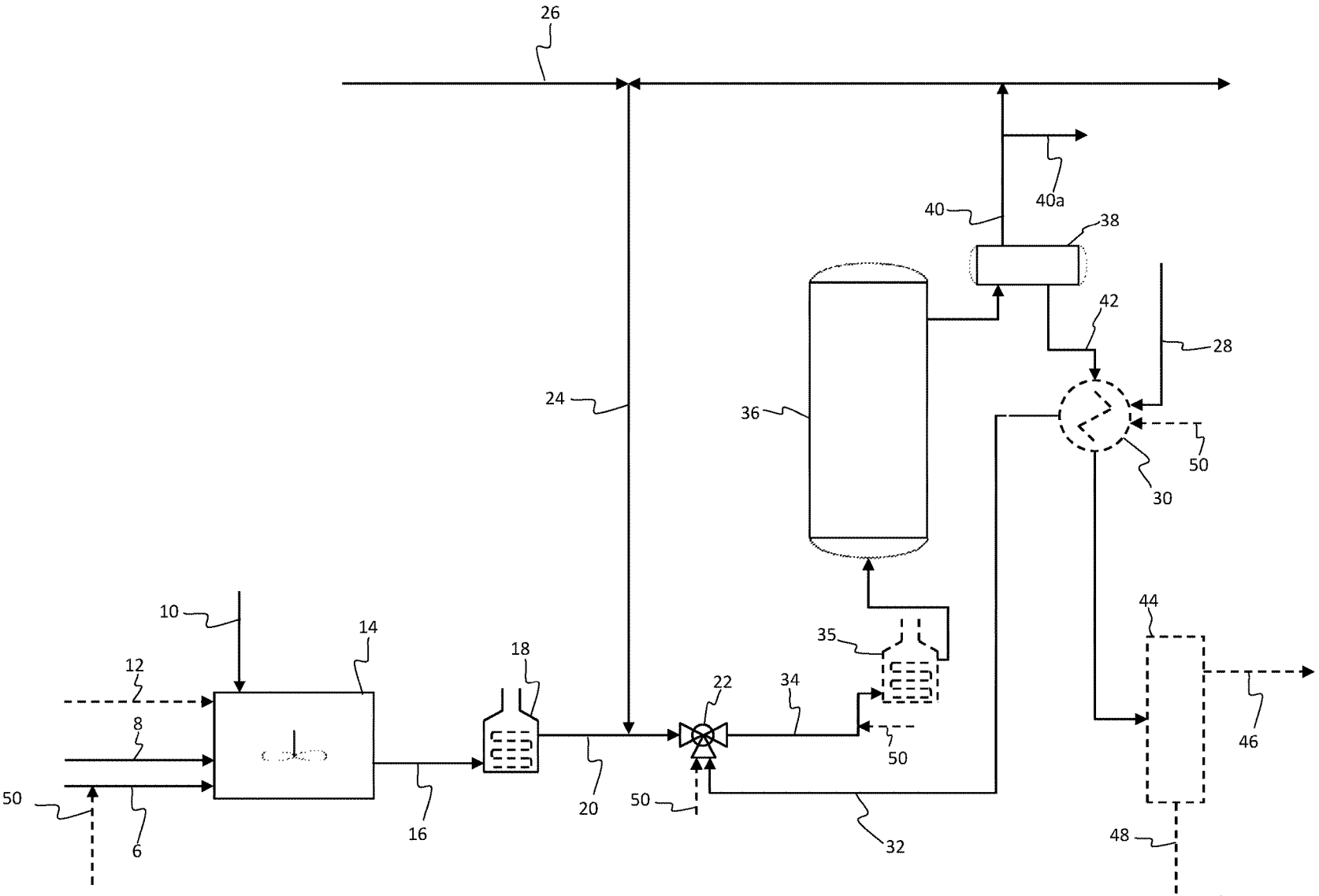
FIG. 1 is a process flow diagram of a process integrating a catalytic hydrogen aquathermolysis unit operation.

Finding new economical processes and unit operations to upgrade heavy petroleum oils, such as atmospheric and/or vacuum residues, is desirable. In addition, there is incentive to utilize otherwise low value by-products of petroleum refining to generate valuable commodities, which can be used as starting materials to generate energy or steam, or for use within upgrading processes. In particular, it is desirable to implement processes with low hydrogen demand and where refiners can utilize hydrogen from a refinery fuel gas (RFG) system.

The present process is concerned with heavy oil upgrading by the combined effects of hydrogen and water in aquathermolysis processes in a single unit operation. In certain embodiments this unit operation is followed by solvent deasphalting. The addition of hydrogen, water, and catalytic particles to the oil medium improves its conversion and minimizes asphaltene generation and aggregation. In addition, the presence of hydrogen and low to moderate operating pressures result in a low level of catalytic hydrotreating.

Heavy oil is upgraded by the disclosed process and unit operation, which combines thermal cracking, hydrogenolysis, and catalytic aquathermolysis. The process is referred to herein as "catalytic hydrogen-aquathermolysis." Types of heavy oil that can benefit from the features of catalytic hydrogen-aquathermolysis include atmospheric and/or vacuum residues containing asphaltenes, nitrogen, sulfur and metal contaminants.

Catalytic hydrogen-aquathermolysis uses thermal energy and highly dispersed homogeneous catalyst combined with steam and/or water, and low quantities of hydrogen, for instance from RFG or other sources, to improve the heavy oil conversion and to suppress asphaltene and coke generation while reducing asphaltene aggregation. This extends the upgrading and conversion opportunities of heavy oil, in that the stream can tolerate increased operating severities in downstream processes as to improve conversion and production.

In additional embodiments, the upgraded oil is treated with a light precipitant to permit asphaltenes to precipitate and thereby reduce the catalyst concentration remaining in the upgraded oil. Furthermore, the addition of precipitant to the heavy oil reduces its viscosity significantly and thereby its ability to hold catalytic particles, which enhances segregation of the catalytic particles under the influence of gravity.

In order to further remove asphaltenes and polynuclear heavy aromatics, in certain embodiments the deasphalted upgraded oil is subjected to a selective adsorption process to capture and retain adsorbates. Adsorbent materials or mixture of adsorbent materials that are effective to capture the heavy large polyaromatic compounds and asphaltenes include those that are characterized by high surface area, large pore volumes, and a wide pores diameter distribution. The deasphalted upgraded oil is then passed to atmospheric and vacuum distillation columns to separate the light products. The heavy bottoms from the vacuum tower can be sent to a bunker fuel oil pool, partially or totally passed to a gasification process, and/or routed back to the catalytic hydrogen-aquathermolysis unit operation for additional upgrading cycles.

In the catalytic hydrogen-aquathermolysis unit operation described herein, the addition of hydrogen, water, and catalytic particles to the oil medium improves the conversion into relatively lighter molecules and minimizes asphaltenes generation and aggregation. In addition, due to the presence of hydrogen and moderate operating pressure, low catalytic hydrotreating occurs, for instance, sulfur removal of up to about 50 W %, and nitrogen removal of up to about 30 W %.

Hydrogen-aquathermolysis reactions occur by simultaneous cleavage of molecular bonds between the heavy oil molecules and their alkyl appendages by thermal energy to produce hydrocarbon free radicals. The highly dispersed catalyst promotes the availability of hydrogen radicals to hydrogenate the produced hydrocarbon free radicals and olefins, which are typical thermal cracking products.

Regardless of the source of hydrogen, the highly dispersed catalyst promotes hydrogen addition reactions to the hydrocarbon free radicals. Compared to supported catalyst matrices, highly dispersed catalytic particles possess numerous advantages that include reduced diffusion control, and improved effective contact between water, oil, hydrogen, and catalyst particles.

The herein described catalytic hydrogen-aquathermolysis process reduces asphaltenes and minimizes coke generation during heavy oil upgrading by using a slurry type catalyst, water and low pressure hydrogen supply, for example from a refinery fuel gas (RFG) system or other sources. The adsorbed and solvent precipitated asphaltenes and heavy residua can be gasified in a downstream process to minimize or nearly eliminate the by-product asphaltenes and residual oils, and to generate valuable products, hydrogen and electricity, in return. In additional embodiments in which adsorbent material is used, such material having asphaltenes adsorbed therein or thereon can also be passed to a gasifying step.

In certain embodiments, the highly dispersed sub-micron or nano-sized catalytic particles used in the catalytic hydrogen-aquathermolysis process do not require support, which minimizes diffusion control in comparison to supported catalysts. The sub-micron or nano-sized catalyst sizes allow for higher dispersion, availability of accessible active sites and improved contact time, which allows for low catalyst concentrations. Utilizing sub-micron or nano-sized catalyst eliminates the potential for heat gradient build up. Moreover, the catalyst also promotes hydrogen addition to the thermally cracked oil free radicals thereby reducing asphaltenes and polycyclic aromatics free radical association and hydrogen abstraction reactions.

A process flow diagram including the herein catalytic hydrogen-aquathermolysis unit operation is shown with reference to FIG. 1. A heavy feedstream 6, water and/or steam 8, and catalytic materials 10 are intimately mixed, for instance using in-line mixing apparatus and/or a separate mixing zone 14 to produce a mixture 16. In certain embodiments a viscosity reducing agent stream 12 can be added. In certain embodiments surfactants and/or co-surfactants can also added. In certain embodiments, a recycle stream 50 is also added. The mixing zone 14, when used instead of or in conjunction with an in-line mixing apparatus, can be a high shear mixing unit such as a continuous stirred tank to produce an intimate mixture. In certain embodiments one or more of aqueous or oil-soluble catalytic metals precursors, viscosity reducing agents, surfactants and co-surfactants can be mixed with the oil feedstock. In certain embodiments, mixing of the initial stream 6 and catalytic materials 10, and optionally the viscosity reducing agent stream 12 and optionally surfactants and/or co-surfactants, occurs in the absence of added hydrogen.

The catalytic particles are sub-micron or nano-sized catalyst particles that become highly dispersed in the mixture 16 due to in-line mixing and/or the mixing zone 14. The in-line mixing apparatus and/or a separate mixing zone 14 is/are effective to enhance catalyst mixing and dispersion, and catalyst in-situ preparation when precursors are used. Mixing occurs at effective temperature and pressure levels, for instance, in the range of about 40-100, 50-100, 40-80 or 50-80° C. and over about 1 bar, for instance in the range of about 1-30, 1-20 or 1-10 bars. Mixing conditions are selected to prevent or minimize vaporization of any added water or other optional components such as viscosity reducing agents, surfactants and co-surfactants.

The resulting mixture 16 of heavy feed, water, highly dispersed catalytic particles and optional components such as viscosity reducing agents, surfactants and co-surfactants, is heated, for instance in a charge heater 18, to provide a pre-heated mixture 20. The addition of water via stream 8 minimizes coke formation in the furnace 18. In certain embodiments, the mixture is pre-heated in the absence of added hydrogen. The heater 18 can be operated under conditions effective as a catalyst preparation step, for instance, to decompose the added catalyst to produce catalytically active materials, or to facilitate catalyst formation when catalyst precursors are provided instead of or in conjunction with catalytically active materials. In certain embodiments, the mixture is pre-heated to a suitable reaction temperature in the range of from about 400-500, 400-460, 400-450, 435-500, 435-460 or 435-450° C. In additional embodiments, the mixture is preheated to a temperature below the reaction temperature, for instance, below about 400, 390, 380 or 370° C., and in certain embodiments in the range of about 350-400, 350-390, 350-380 or 350-370° C., and additional heating occurs in the reactor 36 or in a second heater 35 upstream of the reactor and downstream of a hydrogen and water/steam injection site 22. In certain embodiments, additional heating occurs in the reactor due to back-mixing and the presence of hydrogen and its consumption, to provide a near-isothermal reactor.

The pre-heated mixture 20 of heavy feed and highly dispersed catalyst particles is combined with hydrogen and water and/or steam. In certain embodiments, this stage of the reaction scheme is the first instance of added hydrogen. As shown in FIG. 1 this is via a mixing valve at the hydrogen and water/steam injection site 22, however other apparatus can be used to combine hydrogen, and water and/or steam, together or separately. The added hydrogen, stream 24, can be derived from a suitable source such as a hydrogen containing fuel gas stream, including a low hydrogen partial pressure off-gas stream. Water and/or steam 32 is also combined, together with hydrogen, for example via the mixing valve 22, or separately. The water and/or steam 32 can optionally be preheated using a heat exchanger 30 that heats influent water and/or steam 28 using liquid effluents 42 from the catalytic hydrogen-aquathermolysis reactor 36 via a separator 38. Accordingly, a mixture 34 is provided, for example from the mixing valve 22, which mixture can optionally be further pre-heated via the second heater 35 before charging to the reactor 36.

The catalytic hydrogen-aquathermolysis reactor 36 can be in a tubular reactor configuration or continuous stirred-tank reactor configuration. In the catalytic hydrogen-aquathermolysis reactor 36, thermal cracking occurs in the presence of hydrogen and water to upgrade the heavy oil. A mixed gas and liquid reactor effluent stream is passed to a vapor-liquid separator 38 to separate a light effluent stream 40 containing gases and light liquids from an upgraded heavy oil effluent 42. At least a portion of stream 40 is recovered, stream **40*a*, and passed to a light liquid product recovery unit (not shown). The unrecovered gases can be incorporated with the fuel gas stream 26, for instance to be included with a refinery fuel gas system (not shown). This stream can be used to obtain a low hydrogen partial pressure off-gas stream that can be used as a source of hydrogen 24 for the catalytic hydrogen-aquathermolysis reactor 36**.

The liquid product 42 (or cooled liquid product if the effluent is used as a heat exchanging fluid) from the catalytic hydrogen-aquathermolysis reactor 36 can be recovered as products, for instance, in a bunker C fuel oil pool, or use as an upgraded feedstock in one or more various downstream processes. For example, in FIG. 1 a fractionator unit 44 is shown (from which separated streams can be treated conventionally), in FIGS. 2, 4 and 5 solvent deasphalting processes are shown, in FIG. 3, and adsorption unit is shown. In other embodiments (not shown), a downstream process for treating all or a portion of the liquid product 42 from the catalytic hydrogen-aquathermolysis reactor 36 can include delayed coking processes, full range catalytic hydroprocessing, gasification, or a combination of the aforementioned uses or processes. In certain embodiments, a portion of the effluent from one or more of a downstream fractionator unit, adsorption unit, solvent deasphalting unit, delayed coking unit, or catalytic hydroprocessing unit can be recycled, schematically shown by dashed lines in FIG. 1 as a recycle stream 50. As used herein, stream 50 represents one or more of recycle streams derived from one or more of the aforementioned downstream processes, for instance, stream 48 in FIG. 1. In additional embodiments, the stream 50 can include or all or a portion of effluent of a process treating liquid products from reactor 36, such as heavy products from delayed coking, catalytic hydroprocessing unit such as a resid hydroprocessing unit, adsorption process and/or solvent deasphalting (not shown). The recycle stream 50 can be charged with the feed 6 directly to an in-line mixing apparatus and/or a mixing unit 14 as shown, and/or to one or more of the mixing valve 22, to the charge heater 18 and/or to the reactor 36. Recycle stream 50 can include in the range of from about 0-50, 0-40, 0-30, 5-50, 5-40, 5-30, 10-50, 10-40 or 10-30 W % (based on the total weight of the feed to the reactor 36).

In certain embodiments (indicated as optional by dashed lines in FIG. 1), the liquid product 42 is fractioned in a separation zone 44 to recover hydrocarbon products 46 and bottoms stream 48. Hydrocarbon products including, for example, naphtha, diesel and vacuum gas oils, for example having nominal boiling ranges of about 36-180° C., 180-370° C. and 370-520° C., respectively (although one of skill in the art can appreciate that these ranges can vary), can be recovered and send to other processing units, for instance, a hydrotreating unit for refining and sulfur removal, before being further processed. The bottoms stream 48 can contain unconverted bottoms and having an initial boiling point, for instance, in the range of about 450-565, 500-565 or 520-565° C., and an end point based on the characteristics of the feed 6.

In certain embodiments multiple upgrading cycles are employed to maximize heavy oil conversion and minimize by-products. For example, to carry out multiple upgrading cycles, the bottoms stream 48 can be recycled by charging with the feed 6 directly to an in-line mixing apparatus and/or a mixing unit 14, charging to the mixing valve 22, charging to the heater 18 and/or charging to the reactor 36, represented in FIG. 1 as stream 50. The quantity of bottoms 48 that are recycled as stream 50 can be in the range of 0-100, 0-90, 0-70, 0-50, 10-100, 10-90, 10-70, 10-50, 30-100, 30-90, 30-70, 50-100, 50-90, 50-70 or 30-50 W %. In further embodiments, bottoms 48 from a fractionation step can be treated by solvent deasphalting and/or adsorption as described further herein or another type of processing unit, such as delayed coking processes, resid hydroprocessing and/or gasification, or integrated in an asphalt pool.

To form an effective catalytic emulsion, in certain embodiments one or more of aqueous or oil-soluble catalytic metals precursors, water, aromatic-based viscosity reducing agents, surfactants and co-surfactants can be mixed with oil feedstock, e.g., in mixing unit 14. The viscosity reducing agent can be used when the homogenous catalyst is provided in the form of active sub-micron or nano-sized particles, and when the homogenous catalyst is provided in the form of catalytic precursor material that decomposes in-situ into catalytically active material. The viscosity reducing agent serves to lower the viscosity for adequate mixing and improved flowability. Suitable viscosity reducing agents include those that are low or non-paraffinic in nature, such as light aromatics or light aromatic-rich solvents. For example, one or more refinery streams can be used as a viscosity reducing agent, including but not limited to one or more cycle oil from fluidized catalytic cracking processes, straight run kerosene, or straight run gas oil. The oil feedstock and viscosity reducing agent is thoroughly mixed to reduce the oil viscosity to a suitable level, such as (in centipoises at 40° C.) 200-500, 350-500, 200-400 or 350-400. For example, to achieve a desired viscosity level, the amount of the viscosity reducing (weight % based on the total charged feed) can be in the range of about 10-40, 10-25, 15-40 or 15-25; however the quantity can be determined based on the desired viscosity of the total feed, the viscosity of the initial heavy oil feed and the viscosity of the selected viscosity reducing agent. Further, in certain embodiments in which a homogenous catalyst is provided in the form of an aqueous catalytic precursor material that decomposes in-situ into catalytically active material, an effective amount of surfactant and/or co-surfactant (weight % based on the total charged feed) to achieve a desired level of homogeneity can be in the range of about 0.1-5.0, 0.1-3.0, 0.1-1.5, 0.75-5.0, 0.75-3.0 or 0.75-1.5.

The mixture of oil to be upgraded, water, viscosity reducing agent and any surfactants or co-surfactants is maintained at a suitable temperature and pressure, for instance a temperature in the range of about 0-100° C. and a pressure in the range of about 1-30, 1-20 or 1-10 bars. These conditions are suitable to avoid vaporizing any added water, viscosity reducing agent and any surfactants or co-surfactants.

With the use of homogenous catalysts in the processes and systems described herein, the sub-micron or nano-sized catalytic particles are to be well dispersed prior to charging to the reactor 36. In certain embodiments, a catalytic precursor material is provided which decomposes in-situ into catalytically active material at temperatures within or upstream of the reactor 36, for example at temperatures in the range of about 320-400, 350-400, 360-400, 320-380, 350-380 or 360-380° C. In order to maximize homogenized dispersion of the catalytic particles within the feed to the reactor 36, the particles are dissolved or dispersed homogeneously in a medium such as water (aqueous) or oil (oil-soluble), respectively. In certain embodiments, a surfactant optionally in combination with a co-surfactant are added in order to finely disperse aqueous catalytic precursors and/or particles in the oil medium. In certain embodiments a surfactant and/or co-surfactant is used when the homogenous catalyst is provided in the form of an aqueous catalytic precursor material that decomposes in-situ into catalytically active material. In embodiments in which the homogenous catalyst is provided in the form of active sub-micron or nano-sized particles that do not need to be decomposed into catalytically active material, use of a surfactant and/or co-surfactant is optional. In addition, surfactant and co-surfactant are optional in embodiments in which oil-soluble catalytic metal precursors are utilized. The catalytic precursors, aqueous and/or oil-soluble, are preferably decomposed, since addition of catalytic particles directly to the oil without utilizing a medium increases the potential for agglomeration and poor dispersion of the particles. In embodiments when surfactants and/or co-surfactants are used, they can include materials effective to disperse aqueous catalytic particles in the oil medium having a hydrophilic-lipophilic balance (HLB) in the range of 7-16, 8-16, 7-11 or 8-11. Co-surfactants are added to improve the surfactant effectiveness and share similar range of HLB values as those of the surfactants, however, with different functional groups. For instance, suitable surfactants and co-surfactants are non-ionic surfactants including alcohol ethoxylates, alcohol alkoxylates, fatty acid alkanolamides, alkylamine oxides, oligo(ethylene glycol, alkyl polyglucosides and alkylphenol ethoxylates.

The catalytic emulsion is decomposed to form an oil catalytic suspension, that is, the mixture 16 of heavy feed and highly dispersed catalytic particles, at temperatures below oil cracking temperatures for a given residence time. After preheating in charge heater 18, the mixture is combined at mixing valve 22 with hydrogen 24 at an effective level, such as (in normalized cubic meters of hydrogen to feed ($Nm^3/m^3$)) 1-1000, 1-250, 50-1000 or 50-250. Further, water and/or steam is combined via stream 32 at mixing valve 22 in the range (weight % based on the total mass of the charged feed) of about 1-20, 1-15, 1-10, 3-20, 3-15 or 3-10. Hydrogen can be supplied from the hydrogen rich refinery fuel gas 26 or from another suitable hydrogen source. The use of excess hydrogen from the refinery fuel gas improves refining economics and reduces operating expenditure. Other hydrogen sources including hydrogen from gasification or steam methane reforming can also be utilized after proper treatment.

In certain embodiments, effective mixing of the feed, hydrogen, and water and/or steam is attained by maximizing turbulence at the mixing valve 22. For instance, hydrogen and steam injection can be conducted at an effective angle, for instance, about 90°. After decomposition, that is, catalyst activation, the viscosity reducing agent can be recycled back to the feed preparation unit. The metals in organic or inorganic form decompose to form the catalytically active species. Recovered water can also be recycled to the mixing valve 22 after suitable treatment, or discharged to an API oil-water separator.

In the described process, the addition of low partial pressure hydrogen improves the oil stability and partially desulfurizes and denitrogenizes the oil, resulting in moderately desulfurized and denitrogenized light and heavy hydrocarbon products, for instance, reducing sulfur by about 10-50 wt % and reducing nitrogen by about 5-20 wt %. In addition, hydrogen improves catalyst stability, resulting in a reduction of requisite catalyst volume.

Suitable catalytic materials 10 for the catalytic hydrogen-aquathermolysis reactor are characterized by cracking, desulfurization, denitrogenation, hydrogenation and demetallization functionalities. The highly dispersed homogeneous catalysts are multi-functional unsupported sub-micron or nano-sized particles having at least two metals selected from non-noble transition metal groups, and alkali and/or alkaline groups such as potassium, calcium, and nickel. The catalyst material is captured by the asphaltenes and heavy polyaromatics fraction. Catalyst precursors can include inorganic and organic complexes of elements of Periodic Table of the Elements IUPAC Groups 1 or 2, and/or non-noble transition metals of Groups 4, 5, 6, 7, 8, 9 or 10. For instance, inorganic and organic complexes including potassium, calcium, nickel and/or molybdenum are effective catalyst materials. These metals can be initially in oxide form. In certain embodiments acetates of metal in hydrate form are effective, such as nickel(II) acetate tetrahydrate. In certain embodiments, sulfides of molybdenum or nickel are effective active catalysts. In certain embodiments, oxides molybdenum or nickel are effective active catalysts. Catalyst precursors can be oil-based or in aqueous form. Catalyst particulates in active form are characterized by effective diameters (nanometers) in the range of 5-250, 10-250, 50-250, 5-200, 10-200, 50-200, 10-100, 20-100 or 50-100. The total concentration (ppmw, based on the total feedstock weight) of the catalyst material can be in the range of 100-20,000, 300-20,000, 500-20,000, 1,000-20,000, 100-5,000, 300-5,000, 500-5,000, 1,000-5,000, 100-1,500, 300-1,500, 500-1,500, 1,000-1,500, 100-1,200, 300-1,200, 500-1,200 or 100-1,000.

The catalytic hydrogen-aquathermolysis reactor 36 can be a suitable configuration, such as one or more tubular and/or continuous stirred-tank reactor vessels. The catalytic hydrogen-aquathermolysis reactor 36 operates at suitable conditions, such as: a low to moderate pressures hydrogen partial pressure level, for example in the range of about 5-60, 10-60, 15-60, 20-60, 30-60, 5-50, 10-50, 15-50, 20-50, 30-50, 5-40, 10-40, 20-40, 5-35, 10-35, 5-30, 10-30 or 10-20 bars; a temperature in the range of about 400-500, 400-460, 400-450, 435-500, 435-460 or 435-450° C.; and a liquid hourly space velocity (LHSV) levels, on a fresh feed basis relative to the reactor volume, can be in the range of about 0.1-20, 0.1-10, 1-20, 1-20, 5-20 or 5-10 $h^{-1}$. Catalytic hydrogen-aquathermolysis reactor conditions are optimized to achieve the highest conversion while maintaining suitable stability of asphaltene content. In certain embodiments, the hydrogen-aquathermolysis reactor product is stable, for instance having a P-Value of at least about 1.20±0.05. The P-value (peptization value) test is widely used in oil industry to measure heavy hydrocarbon product's asphaltenes stability, by providing a numerical value which represents the flocculation tendency of asphaltenes (for example, as determined by ASTM method D7060). Typical feedstocks to the catalytic hydrogen-aquathermolysis reactor contain asphaltenes that are stable and in solution, for instance with P-values greater than about 1.5. During processing the ratio of resins to asphaltenes changes, causing instability, which is turn results in sediment formation. In addition, the presence of hydrogen and the low to moderate operating pressures result in a low level of catalytic hydrotreating, for instance, hydrodesulfurization in the range of about 10-80 or 10-50 W % sulfur reduction.

In order to accommodate any lost BTU value in the refinery fuel gas as a result of hydrogen consumption, gaseous products, including C1-C4 gases and impurities such as hydrogen sulfide and ammonia, from the catalytic hydrogen-aquathermolysis reactor 36 (and optionally the fractionator unit when employed) can be sent to the main refinery fuel gas conduit 26.

In certain embodiments, the upgraded oil is treated with a light precipitant such as a C3-C8 or C4-C8 paraffinic solvent, to permit asphaltenes to precipitate and thereby reduces the catalyst concentration remaining in the upgraded oil. The ratio (weight to weight) of light precipitant to the upgraded oil is in the range of about 2:1-10:1, 2:1-8:1, 2:1-7:1, 3:1-10:1, 3:1-8:1, or 3:1-7:1. Furthermore, the addition of precipitant to the heavy oil reduces its viscosity significantly and thereby its ability to hold catalytic particles, which enhances segregation of the catalytic particles under the influence of gravity.

In embodiments in which a downstream process treating liquid products from reactor 36 or bottoms 48 from a fractionation step is a coking process, recycle stream 50 can comprise coker gas oil and/or heavy coker gas oil from coker liquid products. A coking operation can operate in accordance with known cokers used in oil refineries, including more commonly known delayed coker units, and in certain arrangements a fluid coking process. In general, coking operations are carbon rejection processes that are used to convert lower value atmospheric or vacuum distillation residue streams to lighter products, thermally cracked hydrocarbon products. Coking of residuum from heavy high sulfur, or sour, crude oils is typically carried out to convert part of the material to more valuable liquid and gas products. Typical coking processes include delayed coking and fluid coking, with products removed from a coking unit product fractionator, including coker gases, coker naphtha, and coker gas oil (which can discharged as a full range stream or separated into light and heavy coker gas oil). In certain embodiments, for instance with delayed coking units, resulting coke is removed from drums, and is generally treated as a low value by-product or recovered for various uses depending upon its quality. In a fluid coking unit, coke is removed as particles and a portion is recycled to provide hot surfaces for thermal cracking. The coker feedstream, for instance all or a portion of the liquid products from reactor 36 and/or the bottoms stream 48, is mixed with steam and the mixture rapidly heated in a coking furnace to a coking temperature, and then fed to a coking drum. The hot mixed coker feedstream is maintained in the coke drum at coking conditions of temperature and pressure where the feed decomposes or cracks to form coke and volatile components. The volatile components are recovered as vapor and transferred to a coking product fractionator. One or more heavy fractions of the coke drum vapors can be condensed, for example by quenching or heat exchange. In certain embodiments the coke drum vapors are contacted with heavy gas oil in the coking unit product fractionator, and heavy fractions form all or part of a recycle oil stream having condensed coking unit product vapors and heavy gas oil. In certain embodiments, heavy gas oil from the coking feed fractionator is added to a flash zone of the fractionator to condense the heaviest components from the coking unit product vapors. Delayed coking units are typically configured with two or more parallel drums and operated in an alternating swing mode if there are two drums, or in a sequentially cyclic operating mode if there are three or more drums. Parallel coking drum trains, with two or more drums per train, are also possible. When the coke drum is full of coke, the feed is switched to another drum, and the full drum is cooled. Liquid and gas streams from the coke drum are passed to a coking product fractionator for recovery. Any hydrocarbon vapors remaining in the coke drum are removed, for instance by steam injection. The coke remaining in the drum is typically cooled with water and then removed from the coke drum by conventional methods, such as by hydraulic and/or mechanical techniques to remove green coke from the drum walls for recovery. Conditions in the coking drums include a temperature of from about 425-650, 425-510, 425-505, 425-500, 450-650, 450-510, 450-505, 450-500, 485-650, 485-510, 485-505, 485-500, 470-650, 470-510, 470-505 or 470-500° C.; an operating pressure of about 1-20, 1-10 or 1-3 bars, and in certain embodiments is mildly super-atmospheric; with steam introduced or injected with the heated residue at a steam introduction rate of about 0.1-3, 0.5-3 or 1-3 wt % relative to the heated residue, to increase the velocity in the tube furnace, and to reduce the partial pressure of the feedstock oil in the drum; and in cycles in the range of about 10-30, 10-24, 10-18, 12-30, 12-24, 12-18, 16-30, 16-24 or 16-18 hours. In certain embodiments, a fluid coking process is used, wherein circulated coke particles contact the feed and in which coking occurs on the surface of the coke particles, for instance similar to a Flexicoking™ process commercially available from ExxonMobil. In operation of a fluid coking unit, the coker feed, for instance all or a portion of the liquid products from reactor 36 and/or the bottoms stream 48, and steam are introduced into a coking furnace for heating to a predetermined temperature or temperature range, for instance, typically at about the coking temperature. For example, a fired furnace or heater with horizontal tubes is used to reach temperature levels that are at or below thermal cracking temperatures, for instance, in the range of about 425-650, 425-570, 425-525, 450-650, 450-570, 450-525, 485-650, 485-570 or 485-525° C. With a short residence time in the furnace tubes of the coking furnace, and with addition of steam, coking of the feed material on the furnace tubes is minimized or obviated. In the fluid coking unit, coking occurs on coke particles in the coker reactor. Further, additional heat for coking is provided by recirculating combusted heated coke particles in the coking drum.

In embodiments in which a downstream process treating liquid products from reactor 36 or bottoms 48 from a fractionation step is a catalytic hydroprocessing unit, such as a resid hydroprocessing unit, recycle stream 50 comprises heavy liquid process bottoms from that unit, for instance boiling above about 450, 475, 500 or 520° C. Accordingly, all or a portion of instance all or a portion of the liquid products from reactor 36 and/or the bottoms stream 48 can be passed to a resid hydrotreater, for example, which can be a fixed bed, slurry or ebullated bed reactor operating with effective hydrotreating catalyst at suitable conditions (for instance, a resid hydrotreater can operate at a reactor temperature in the range of from about 370-470, 370-450, 370-440, 370-430, 380-470, 380-450, 380-440, 380-430, 390-450, 390-440 or 390-430° C.; a hydrogen partial pressure in the range of from about 80-250, 80-200, 80-150, 90-250, 90-200, 90-150, 100-250, 100-200 or 100-150 barg; a hydrogen gas feed rate of up to about 3500, 3000 or 2500, in certain embodiments from about 1000-3500, 1000-3000, 1000-2500, 1500-3500, 1500-3000, 1500-2500, 2000-3500, 2000-3000 or 2000-2500 standard liters per liter of hydrocarbon feed (SLt/Lt); and a liquid hourly space velocity, on a fresh feed basis relative to the hydrotreating catalysts, in the range of from about 0.1-4.0, 0.1-2.0, 0.1-1.5, 0.1-1.0, 0.2-4.0, 0.2-2.0, 0.2-1.5, 0.2-1.0, 0.5-4.0, 0.5-2.0, 0.5-1.5 or 0.5-2.0 $h^{-1}$. Suitable catalysts for a resid hydrotreater generally contain an effective amount, such as about 5-40 wt % based on the weight of the catalyst, of one or more active metal component(s) of metals or metal compounds (oxides or sulfides) selected from the Periodic Table of the Elements IUPAC Groups 6, 7, 8, 9 and 10. In certain embodiments, the active metal component(s) is/are one or more of Co, Ni, W and Mo. The active metal component(s) is/are typically deposited or otherwise incorporated on a support, such as amorphous alumina, amorphous silica alumina, zeolites, or combinations thereof. One or more series of reactors can be provided, with different catalysts in the different reactors of each series. LPG, naphtha and middle distillates can be recovered, with heavy oil and pitch remaining. All or a portion of the heavy oil and/or pitch can be used as the recycle stream 50.

In certain embodiments in which the process treating liquid products from reactor 36 is a solvent deasphalting process, the recycle stream 50 can comprise the portion that is not soluble in C3 to C8 paraffinic solvent used for deasphalting. Solvent deasphalting can be integrated to separate asphaltenes from all or a portion of the liquid product of reactor 36, or all or a portion of bottoms from a fractionator that received the liquid product of reactor 36, such as for example stream 48 described with respect to FIG. 1. In embodiments of the present process in which the feed to the solvent deasphalting operation contains unsupported catalyst materials, sub-micron or nano-sized catalytic particles pass with the asphalt phase. These particles are present, for instance, in the range of up to about 5000, 1000 or 500 ppmw, for instance concentration about 300-500, 300-3000, 300-1800, 300-1000, 300-500, 460-5000, 460-3000, 460-1800 or 460-1000 ppmw.

As is known, solvent deasphalting uses a suitable solvent to precipitate the asphaltenes fraction from the feed. In general, in a solvent deasphalting zone, the feed is mixed with the solvent so that the deasphalted oil is solubilized in the solvent. The insoluble pitch precipitates out of the mixed solution. Separation of the deasphalted oil (DAO) phase (solvent-DAO mixture) and the asphalt/pitch phase typically occurs in one or more vessels or extractors designed to efficiently separate the two phases and minimize contaminant entrainment in the DAO phase. The DAO phase is then heated to conditions at which the solvent becomes supercritical. Under these conditions, the separation of the solvent and DAO is facilitated in a DAO separator. Any entrained solvent in the DAO phase and the pitch phase is stripped out, typically with a low pressure steam stripping apparatus. Recovered solvent is condensed and combined with solvent recovered under high pressure from the DAO separator. The solvent is then recycled back to be mixed with the feed.

Solvent deasphalting is carried-out in liquid phase thus the temperature and pressure are set accordingly. There are generally two stages for phase separation in solvent deasphalting. In a first separation stage, the temperature is maintained at a lower level than the temperature in the second stage to separate the bulk of the asphaltenes. The second stage temperature is carefully selected to control the final deasphalted/demetallized oil quality and quantity. Excessive temperature levels will result in a decrease in deasphalted/demetallized oil yield, but the deasphalted/demetallized oil will be lighter, less viscous, and contain less metals, asphaltenes, sulfur, and nitrogen. Insufficient temperature levels have the opposite effect such that the deasphalted/demetallized yield increases but the product quality is reduced. Operating conditions for solvent deasphalting units are generally based on a specific solvent and charge stock to produce a deasphalted/demetallized oil of a specified yield and quality. Therefore, the extraction temperature is essentially fixed for a given solvent, and only small adjustments are typically made to maintain the deasphalted/demetallized oil quality. The composition of the solvent is also an important process variable. The solubility of the solvent increases with increasing critical temperature, such that C3<iC4<nC4<iC5, i.e., the solubility of iC5 is greater than that of nC4, which is greater than that of iC4, is greater than that of C3. An increase in critical temperature of the solvent increases the deasphalted/demetallized oil yield. However, solvents having higher critical temperatures afford less selectivity resulting in lower deasphalted/demetallized oil quality. Solvent deasphalting units are operated at pressures that are high enough to maintain the solvent in the liquid phase, and are generally fixed and vary with solvent composition. The volumetric ratio of the solvent to the solvent deasphalting unit charge is also important in its impact on selectivity, and to a lesser degree, on the deasphalted/demetallized oil yield. The major effect of the solvent-to-oil ratio is that a higher ratio results in a higher quality of the deasphalted/demetallized oil for a fixed deasphalted/demetallized yield. A high solvent-to-oil ratio is preferred because of better selectivity, but increased operating costs conventionally dictate that ratios be limited to a relatively narrow range. Selection of the solvent is also a factor in establishing operational solvent-to-oil ratios. The necessary solvent-to-oil ratio decreases as the critical solvent temperature increases. The solvent-to-oil ratio is, therefore, a function of desired selectivity, operation costs and solvent selection. In certain embodiments, the solvent-to-oil ratio (weight to weight) is in the range of about 2:1-10:1, 2:1-8:1, 2:1-7:1, 3:1-10:1, 3:1-8:1, or 3:1-7:1.

In known solvent deasphalting operations, the asphalt phase contains a majority of the contaminants from the charge, i.e., metals, asphaltenes, Conradson carbon, and is also rich in aromatic compounds and asphaltenes. In addition to the solvent deasphalting operations described herein, other solvent deasphalting operations, although less common, are suitable. For instance, a three-product unit, in which resin, DAO and pitch can be recovered, can be used, where a range of bitumens can be manufactured from various resin/pitch blends.

Figure 2:
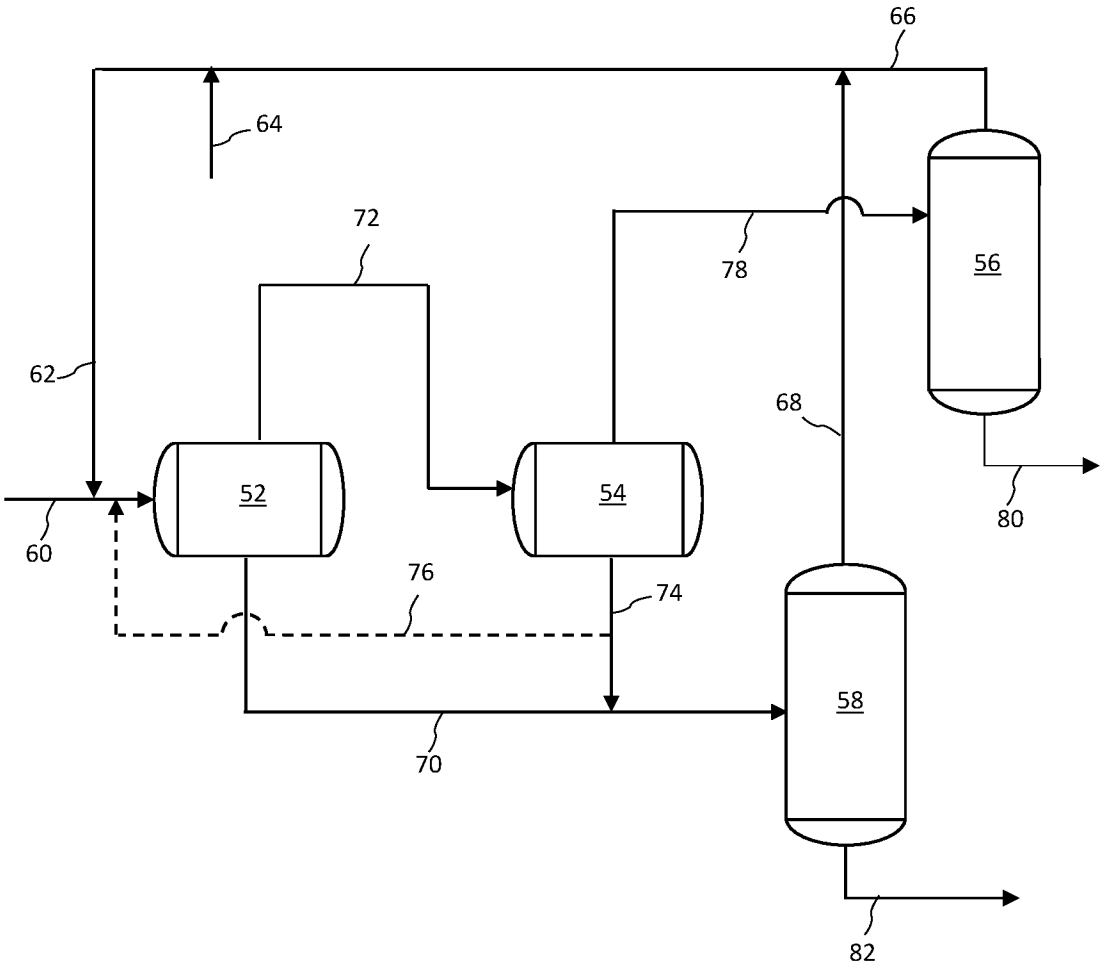
FIG. 2 is a process flow diagram of a solvent deasphalting process effective to separate asphaltenes and in certain embodiments spent catalyst materials from the catalytic hydrogen aquathermolysis effluent.

In an example of a typical solvent deasphalting unit that can be integrated with the herein catalytic hydrogen-aquathermolysis process, FIG. 2 schematically depicts an embodiment of a solvent deasphalting zone that can be integrated with the herein catalytic hydrogen-aquathermolysis process. The solvent deasphalting zone receives a feed 60, which can include liquid products from reactor 36 described herein and in conjunction with FIG. 1, or bottoms from a fractionator downstream of reactor 36, such as stream 48, wherein feed 60 contains dispersed metal particles that were present in the feed to reactor 36 and are removed in the solvent deasphalting zone. In further embodiments, feed 60 can be heavy liquid products from a catalytic hydroprocessing unit, such as resid hydroprocessing; in these embodiments, dispersed metal particles that are contained in the heavy liquid products are removed in the solvent deasphalting zone. The dispersed metal particles from the catalyst concentrate in the heaviest unconverted oil fraction by the viscosity slump effect. The polarity of the catalytic metal particles induces their attraction to the heaviest fraction of the oil through polar-polar interactions. Metal particulates are encapsulated by the heavy polyaromatic condensed compounds and asphaltenes by a caging effect. Any metal particles remaining in the deasphalted oil can be separated, for instance, by electrostatic precipitation. In other embodiments, feed 60 can include or all or a portion of effluent of a process treating liquid products 42 from reactor 36 or the heavy portion 48, such as heavy liquid products from a delayed coking unit, whereby all or a portion of the dispersed metal particles have been removed with the coke removed from the coking unit.

An example of a solvent deasphalting zone generally includes primary phase separation zone 52, secondary phase separation zone 54, a deasphalted oil separation zone 56 and an asphalt separation zone 58. Primary phase separation zone 52 includes an inlet for receiving the feed 60 and solvent 62, which can comprise solvent make-up 64, recycle solvent stream 66, and/or recycle solvent stream 68. The feed 60 comprises, consists or, or consists essentially of, all or a portion of the liquid product of reactor 36, or all or a portion of bottoms from a fractionator that received the liquid product of reactor 36, such as for example stream 48 described with respect to FIG. 1. In certain embodiments, a solvent drum (not shown) is integrated to receive the sources of recycle and make-up solvent in the solvent deasphalting system. Primary phase separation zone 52 also includes an outlet for discharging an asphalt phase 70 and an outlet for discharging a reduced asphalt content phase 72, which is the primary DAO phase. Secondary phase separation zone 54 includes an inlet in fluid communication with the primary DAO phase 72 outlet from primary phase separation zone 52, and an outlet for discharging an asphalt phase 74, all or a portion of which can optionally be in fluid communication with primary phase separation zone 52 via line 76 (shown in dashed lines). Secondary phase separation zone 54 includes an outlet for discharging a secondary DAO phase 78 in fluid communication with a DAO inlet of separation zone 56. Separation zone 56 includes an outlet for discharging a solvent stream 66, which is in fluid communication with the primary phase separation zone 52, and an outlet for discharging DAO product 80. The asphalt stream 70 outlet is in communication with the inlet of separation zone 58 for solvent recovery. The asphalt stream 70 can optionally be heated before being passed to the inlet of separation zone 58. Separation zone 58 also includes an outlet for discharging a recycle solvent stream 68, which is in fluid communication with the primary phase separation zone 52, and an outlet for discharging asphalt 82.

In the operation of a deasphalting process herein, the feed 60, in certain embodiments having dispersed particles from the catalysts used in the catalytic hydrogen-aquathermolysis reactor, and solvent stream 62, are mixed, for example using an in-line mixer or a separate mixing vessel (not shown). Mixing can occur as part of the primary phase separation zone 52 or prior to entering the primary phase separation zone 52. Solvent stream 62 includes all or a portion of recycle streams 66, 68 and make-up solvent stream 64. The mixture of hydrocarbon and solvent is passed to primary phase separation zone 52 in which phase separation occurs. Primary phase separation zone 52 serves as the first stage for the extraction of DAO from the feedstock. The two phases formed in the primary phase separation zone 52 are an asphalt phase and a primary DAO phase, which are recovered via outlets 70, 72 respectively. In embodiments using a feed 60 having dispersed particles from the catalysts used in the catalytic hydrogen-aquathermolysis reactor, all or a substantial quantity of those particles are removed with the asphalt phase. For instance, at least about 75, 85, 90, 95, or 99 weight percent, based on the total weight of the catalyst particles used, can be removed. The temperature at which the contents of the primary phase separation zone 52 are maintained is sufficiently low to maximize recovery of the DAO from the feedstock. In general, components with a higher degree of solubility in the non-polar solvent will pass with the primary DAO phase 72. The primary DAO phase 72 includes a major portion of the solvent, a minor portion of the asphalt content of the feedstock and a major portion of the DAO content of the feedstock.

Conditions in the primary phase separation zone 52 are maintained below the critical temperature and pressure of the solvent. In certain embodiments the solvent selected for use in the mixing vessel and first separation vessel in the enhanced solvent deasphalting process herein is a C3 to C8 paraffinic solvent. The following Table 1 provides critical temperature and pressure data for C3 to C8 paraffinic solvents:

TABLE 1

| Carbon Number | Temperature, ° C. | Pressure, bar |
|---|---|---|
| C3 | 97 | 42.5 |
| C4 | 152 | 38.0 |
| C5 | 197 | 34.0 |
| C6 | 235 | 30.0 |
| C7 | 267 | 27.5 |
| C8 | 295.8 | 24.9 |

In a typical solvent deasphalting unit, the primary DAO phase 72 from primary phase separation zone 52 is passed to secondary phase separation zone 54 which serves as the final stage for the extraction. An asphalt phase separates and forms at the bottom of secondary phase separation zone 54 that, due to increased temperature, is approaching the critical temperature of the solvent. The asphalt phase, in certain embodiments including metal particles from the catalytic hydrogen-aquathermolysis reactor effluent, is recovered via an outlet 74 and can contain a small amount of solvent and DAO. The asphalt phase 74 is optionally recycled back to primary phase separation zone 52 for the recovery of the remaining DAO, or optionally mixed with asphalt stream 70. The secondary DAO phase is discharged as stream 78 from secondary phase separation zone 54 and is typically passed to the DAO separation zone 56 to recover and recycle solvent.

The DAO separation zone 56 contains one or more suitable vessels arranged and dimensioned to permit a rapid and efficient flash separation of solvent from DAO stream 72. The solvent is flashed from DAO separation zone 56 and discharged as a stream 66, for recycle to the primary phase separation zone 52. A bottoms stream 80 from the separation zone 56 is the DAO that is optionally passed to a steam stripper (not shown) for steam stripping of the product as is conventionally known to recover a steam stripped DAO product stream, and a steam and solvent mixture for solvent recovery. In certain embodiments, steam stripping can be avoided.

The asphalt stream 70 from the primary phase separation zone 52 is charged to asphalt separation zone 58. The asphalt stream 70 can optionally be heated in heater (not shown) before being passed to the inlet of separation zone 58. Additional solvent is flashed from separation zone 58 and discharged as a stream 68, for recycle to the primary phase separation zone 52. A bottoms asphalt stream 82 from separation zone 58 is optionally passed to a steam stripper (not shown) for steam stripping of the asphalt as conventionally known to recover a steam stripped asphalt phase, and a steam and solvent mixture for solvent recovery. In the embodiments utilizing a feed 60 containing dispersed particles from the catalysts used in the catalytic hydrogen-aquathermolysis reactor, all or a substantial portion of those particles pass to the asphalt stream 82. The asphalt stream 82, containing precipitated asphaltenes, are removed from the solvent deasphalting unit on regular basis to facilitate the deasphalting process, and precipitated asphaltenes can be sent to other refining processes such as gasification or delayed coking, or integrated in an asphalt pool.

In certain embodiments of the integrated process herein, and to maximize yield and minimize asphalt and/or resin in the system, one or more of the asphalt phase streams from solvent deasphalting can be recycled to the catalytic hydrogen-aquathermolysis reactor 36. For instance, this can include all or a portion of the asphalt stream 70 from the primary phase separation zone 52, all or a portion of the asphalt stream 74 from the secondary phase separation zone 55, and/or all or a portion of the asphalt stream 82 from the separation zone 58. This recycle can be charged as depicted in FIG. 1 with respect to stream 50. In further embodiments, a portion of the deasphalted upgraded oil 66 is recycled to the catalytic hydrogen-aquathermolysis reactor 36, directly or via mixing unit 14, mixing valve 22, and/or the charge heater 18, as all or a portion of the recycle stream 50.

In embodiments in which the process treating liquid products from reactor 36 is an adsorption process, recycle stream 50 comprises heavy hydrocarbons separated from desorption solvent, for instance those eluted with solvents having a Hildebrand solubility factor of at least 14. Adsorption can be integrated in certain embodiments to further remove asphaltenes, sulfur and nitrogen containing molecules and polynuclear heavy aromatics. Adsorption can be carried out on one or more of catalytic hydrogen-aquathermolysis effluent or heavy portions of effluent from one or more various processes downstream of catalytic hydrogen-aquathermolysis. In certain embodiments all or a portion of the liquid product of reactor 36, or all or a portion of bottoms from a fractionator that received the liquid product of reactor 36, such as for example stream 48 described with respect to FIG. 1, can be contacted with effective type(s) and quantity of adsorbent material, and under effective conditions, to remove asphaltenes, sulfur and nitrogen containing molecules and polynuclear heavy aromatics. In certain embodiments all or a portion of DAO derived from solvent deasphalting of the catalytic hydrogen-aquathermolysis effluent 42 or effluent bottoms 48 can be contacted with effective type(s) and quantity of adsorbent material, and under effective conditions, to remove asphaltenes and polynuclear heavy aromatics for further downstream treatment.

In one embodiment an adsorption feed is contacted with an effective type(s) and quantity of adsorbent material, and under effective conditions, to remove asphaltenes and polynuclear heavy aromatics. The resulting mixture is subjected to atmospheric distillation to recover distillates, for example, having an initial boiling point of about 36° C. and a final boiling point between about 350-400° C.; such as naphtha, kerosene and gas oil, and atmospheric residue, with the adsorbent material passing with the atmospheric residue. At this stage, asphaltenes, sulfur and nitrogen containing molecules and polynuclear heavy aromatics from the feed are adsorbed on and/or within the pores of the adsorbent material. The mixture of atmospheric residue and adsorbent material can further be separated in a vacuum distillation unit, to recover distillates, for instance having an initial boiling point between about 350-480° C. and a final boiling point between about 480-560° C., such as vacuum gas oil, and vacuum residue, with the adsorbent material passing with the vacuum residue. The adsorbent material can be regenerated and recycled to the returned for e. recovering and returning regenerated adsorbent material for contacting with the feed. An example of a process and system that can be integrated in this manner is disclosed in commonly owned U.S. Pat. Nos. 7,799,211 and 8,986,622, which are incorporated herein in their entireties.

Figure 3:
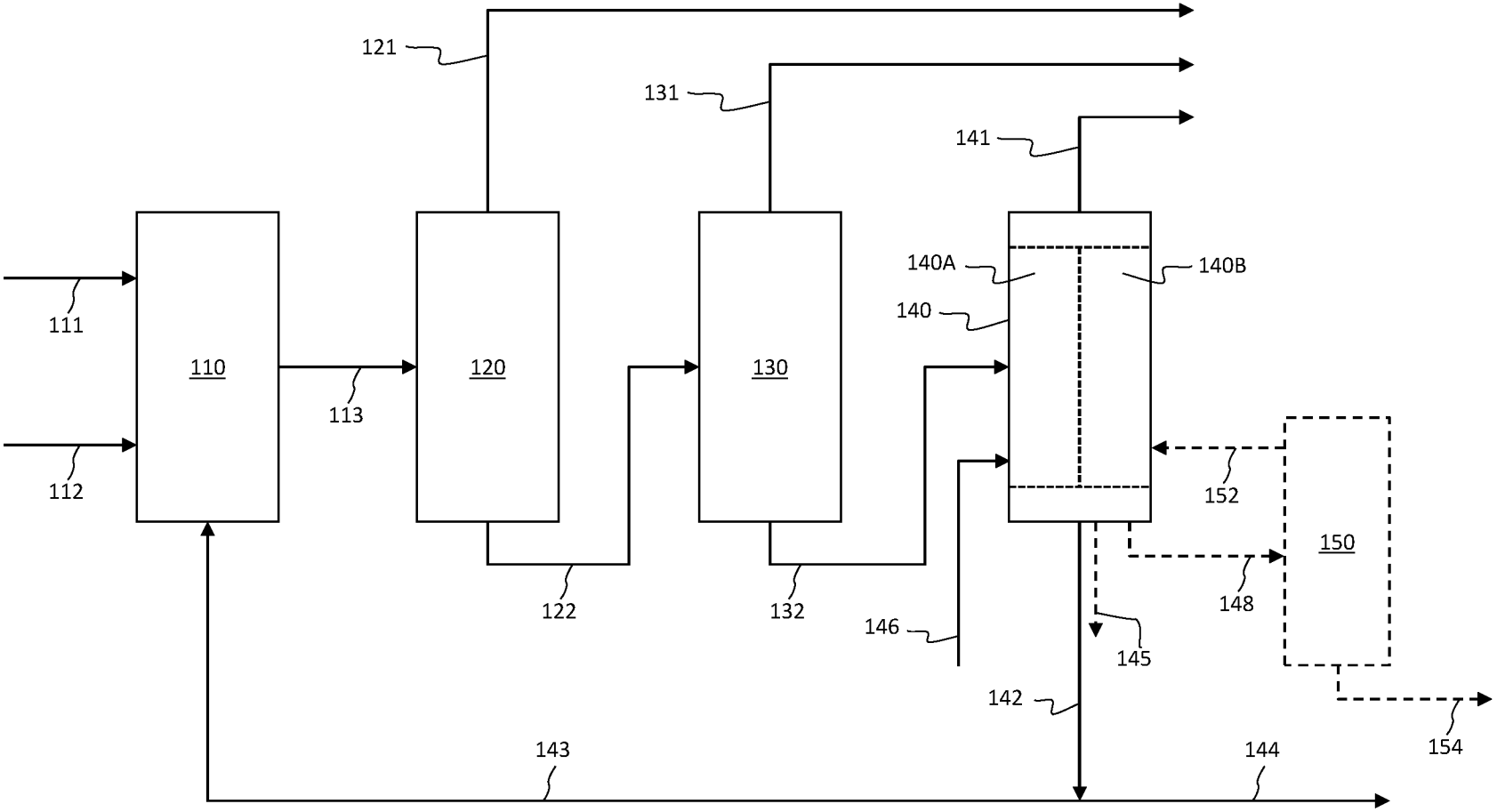
FIG. 3 is a process flow diagram of an adsorption process effective to remove asphaltenes, polynuclear heavy aromatics asphaltenes and in certain embodiments spent catalyst materials from the catalytic hydrogen aquathermolysis effluent.

For example, with reference to FIG. 3, an integrated adsorption system is shown, having as a feedstream 111 all or a portion of the catalytic hydrogen-aquathermolysis reactor effluent, such as effluent 42, or the bottoms stream 48, both described with respect to FIG. 1. In certain embodiments the feedstream 111 contains dispersed metal particles that were present in the feed to reactor 36, and are removed in the integrated adsorption system. In further embodiments, feedstream 111 can be heavy liquid products from a catalytic hydroprocessing unit, such as resid hydroprocessing; in these embodiments, dispersed metal particles that are contained in the heavy liquid products are removed in the adsorption zone. The dispersed metal particles from the catalyst concentrate in the heaviest unconverted oil fraction by the viscosity slump effect. The polarity of the catalytic metal particles induces their attraction to the heaviest fraction of the oil through polar-polar interactions. Metal particulates are encapsulated by the heavy polyaromatic condensed compounds and asphaltenes by a caging effect. Any metal particles remaining in the adsorption treated oil can be separated, for instance, by electrostatic precipitation. In other embodiments, feedstream 111 can include or all or a portion of effluent of a process treating liquid products 42 from reactor 36 or the heavy portion 48, such as heavy liquid products from a delayed coking unit, whereby all or a portion of the dispersed metal particles have been removed with the coke removed from the coking unit. In additional embodiments, feedstream 111 can include or all or a portion of DAO from a solvent deasphalting operation that separates asphaltenes from liquid products 42 obtained from reactor 36 or the heavy portion 48, whereby all or a portion of the dispersed metal particles have been removed with the asphalt phase.

The integrated adsorption system shown in FIG. 3 includes a contacting or mixing vessel 110, an atmospheric flash separator vessel 120, a vacuum flash separator vessel 130, a filtration/regeneration vessel 140, and in certain embodiments a solvent treatment vessel 150. In an embodiment of continuous process using the adsorption system of FIG. 3, the feedstream 111 and solid adsorbent 112 are fed to the contacting vessel 110 and mixed to form a slurry. The contacting vessel 110 can be operated as an ebullient bed or fixed-bed reactor, a tubular reactor or a continuous stirred-tank reactor. In certain embodiments, the contacting vessel 110 operates as a mixing vessel, equipped with suitable mixing apparatus such as rotary stirring blades or paddles, which provide a gentle, but thorough mixing of the contents. The rate of agitation for a given vessel and mixture of adsorbent, solvent and feedstock is selected so that there is minimal, if any, attrition of the adsorbent granules or particles.

The solid adsorbent/crude oil slurry mixture 113 is then transferred to the atmospheric flash separator 120 to separate and recover the atmospheric distillates 121. The atmospheric residue bottoms stream 122 from vessel 120 is sent to the vacuum flash separator vessel 130. The vacuum distillates stream 131 is withdrawn from the top of vessel 130 and the bottoms 132 containing the vacuum flash residue and solid adsorbent are sent to the solvent adsorbent regeneration unit vessel 140. The vacuum residue product 141 is withdrawn from the top of vessel 140 and the bottoms 142 are removed and separated so that the reusable regenerated adsorbents 143 are recycled back and introduced with fresh adsorbent material 112 and feedstock 111 into vessel 110; the unused portion 144 of the regenerated adsorbent is removed for disposal.

In certain embodiments, the adsorbent regeneration unit 140 is operated in swing mode so that production of the regenerated absorbent is continuous. When the adsorbent material in stream 132 from vacuum distillation unit 130 that is introduced into one regeneration unit, for example, 140A, reaches capacity, the flow of feedstream 132 is then directed to the other column 140B. The adsorbed compounds are desorbed, for example by heat or solvent treatment. The nitrogen and PNA-containing adsorbed compounds can be desorbed by either applying heat with an inert nitrogen gas flow at the pressure of 1-10 Kg/cm2 or by desorption with an available fresh or recycled solvent stream 146 or 152, or a refinery stream, such as naphtha, diesel, toluene, acetone, methylene chloride, xylene, benzene or tetrahydrofuran, for example, in the temperature (° C.) range of from about 20-250.

In the case of heat desorption, the desorbed compounds are removed from the bottom of the column as stream 145 for use in other refinery processes, such as residue upgrading facilities, including hydroprocessing, coking, the asphalt plant, or is used directly in fuel oil blending.

In the case of solvent desorption, solvents are selected based on their Hildebrand solubility factors or by their two-dimensional solubility factors. The overall Hildebrand solubility parameter is a well-known measure of polarity and has been calculated for numerous compounds. See, for example, Journal of Paint Technology, vol. 39, no. 505 (February 1967). Appropriate solvents can also be described by their two-dimensional solubility parameter comprised of the complexing solubility parameter and the field force solubility parameter. See, for example, I. A. Wiehe, Ind & Eng. Res., 34(1995), 661. The complexing solubility parameter component, which describes the hydrogen bonding and electron donor-acceptor interactions, measures the interaction energy that requires a specific orientation between an atom of one molecule and a second atom of a different molecule. The field force solubility parameter, which describes the van der Waals and dipole interactions, measures the interaction energy of the liquid that is not destroyed by changes in the orientation of the molecules.

In accordance with the embodiment of FIG. 3, the non-polar solvent, or solvents, if more than one is employed, preferably have an overall Hildebrand solubility parameter of less than about 18.0 or the complexing solubility parameter of less than 0.5 and a field force parameter of less than 7.5. Suitable non-polar solvents include, for example, saturated aliphatic hydrocarbons such as pentanes, hexanes, heptanes, paraffinic naphthas, C5-C11, kerosene C12-C15, diesel C16-C20, normal and branched paraffins, mixtures of any of these solvents. In certain embodiments the solvents are C5-C7 paraffins and C5-C11 paraffinic naphthas.

In accordance with the embodiment of FIG. 3, the polar solvent(s) have an overall solubility parameter greater than about 18 or a complexing solubility parameter of greater than 1 and field force parameter of greater than 8. Examples of polar solvents meeting the desired minimum solubility parameter are toluene (18.3), benzene (18.7), xylenes (18.2), and tetrahydrofuran (18.5). In certain embodiments the polar solvents are toluene or tetrahydrofuran.

In the case of solvent desorption, the solvent and rejected stream 148 from the adsorbent tower is sent to a fractionation unit 150 within the battery limits. The recovered solvent stream 152 is recycled back to the adsorbent regeneration unit 140, or 140A and 140B, for reuse. The bottoms stream 154 from fractionation unit 150 can be sent to other refinery processes.

In other embodiments, enhanced solvent deasphalting can be integrated with catalytic hydrogen-aquathermolysis. For example, enhanced solvent deasphalting processes, such as those described in commonly owned U.S. Pat. No. 7,566,394, which is incorporated by reference herein in its entirety, are used to treat all or a portion of the catalytic hydrogen-aquathermolysis reactor effluent.

Figure 4:
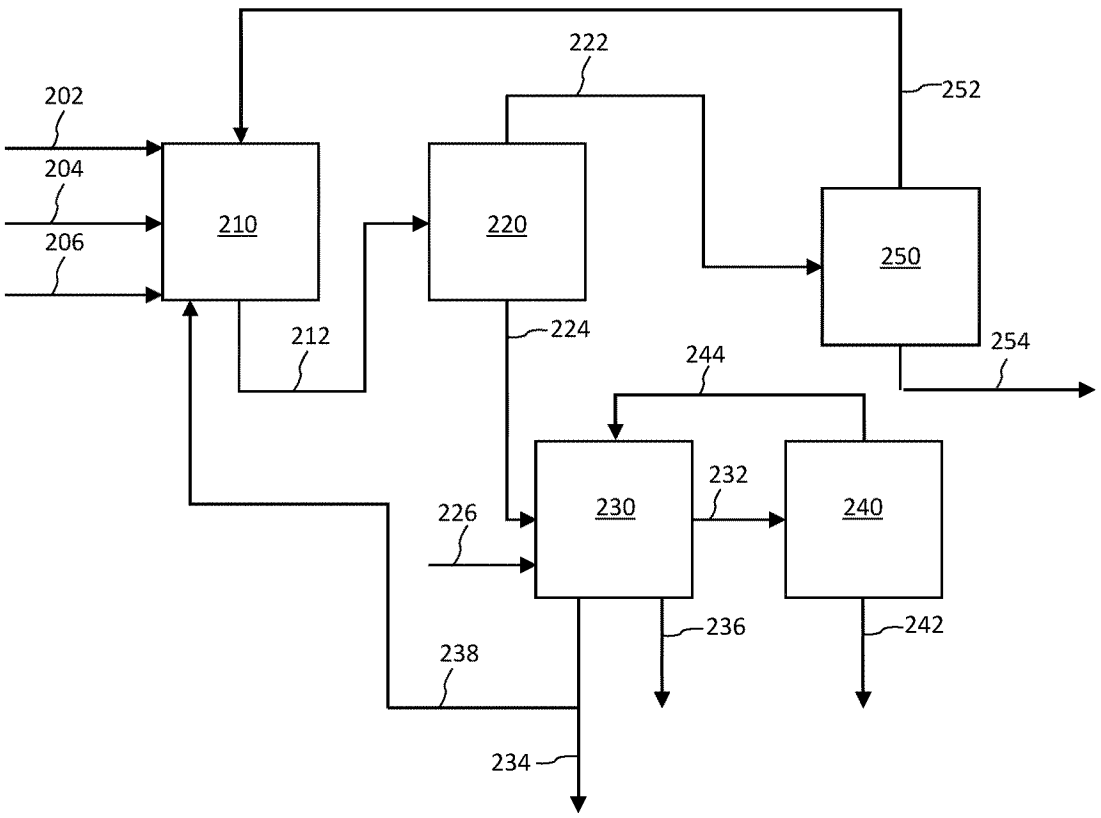
FIG. 4 is a process flow diagram of an adsorption-enhanced solvent deasphalting process effective to separate asphaltenes and in certain embodiments spent catalyst materials from the catalytic hydrogen aquathermolysis effluent.

For example, with reference to FIG. 4, an embodiment of an enhanced solvent deasphalting process is shown, having as a feedstream 202 all or a portion of the catalytic hydrogen-aquathermolysis reactor effluent, such as effluent 42, or the bottoms stream 48 (both described with respect to FIG. 1). In certain embodiments the feedstream 202 contains dispersed metal particles that were present in the feed to reactor 36, and are removed in the integrated adsorption system. In further embodiments, feedstream 202 can be heavy liquid products from a catalytic hydroprocessing unit, such as resid hydroprocessing; in these embodiments, dispersed metal particles that are contained in the heavy liquid products are removed in the enhanced solvent deasphalting zone. The dispersed metal particles from the catalyst concentrate in the heaviest unconverted oil fraction by the viscosity slump effect. The polarity of the catalytic metal particles induces their attraction to the heaviest fraction of the oil through polar-polar interactions. Metal particulates are encapsulated by the heavy polyaromatic condensed compounds and asphaltenes by a caging effect. Any metal particles remaining in the deasphalted oil can be separated, for instance, by electrostatic precipitation. In other embodiments, feedstream 202 can include or all or a portion of effluent of a process treating liquid products 42 from reactor 36 or the heavy portion 48, such as heavy liquid products from a delayed coking unit, whereby all or a portion of the dispersed metal particles have been removed with the coke removed from the coking unit.

The system shown with respect to FIG. 4 includes a mixing vessel 210, a first separation vessel 220, a filtration vessel 230, a fractionator 240, and a second separation vessel 250. A heavy hydrocarbon feedstream 202, a paraffinic solvent 204 and solid adsorbent slurry 206 having an effective quantity of solid adsorbent material are introduced into the mixing vessel 210. Mixing vessel 210 is equipped with suitable mixing apparatus such as rotary stirring blades or paddles, which provide a gentle, but thorough mixing of the contents. The rate of agitation for a given vessel and mixture of adsorbent, solvent and feedstock is selected so that there is minimal, if any, attrition of the adsorbent granules or particles. For example, mixing can be carried out for 30 to 150 minutes.

The mixture of the feedstream 202, paraffinic solvent 204 and solid adsorbent 206 is discharged through line 212 to a first separation vessel 220 at a temperature and pressure that is below the critical temperature and pressure of the solvent to separate the feed mixture into an upper layer comprising light and less polar fractions that are removed as stream 222 and bottoms comprising asphaltenes and the solid adsorbent 224. A vertical flash drum can be utilized for this separation step. Similar to the solvent deasphalting process described with respect to FIG. 2, conditions in the mixing vessel and first separation vessel are maintained below the critical temperature and pressure of the solvent.

The asphalt and adsorbent slurry 224 is mixed with an aromatic and/or polar solvent stream 226 in a filtration vessel 230 to separate and clean the adsorbent material. The solvent stream 226 can be similar to that described with respect to the adsorption system described with respect to FIG. 3 above. In certain embodiments, the adsorbent slurry and asphalt mixture 224 is washed with aromatic or polar solvent 226 in a solvent to feed ratio (weight to weight) of about 1:1-8:1, 1:1-6:1, or 1:1-3:1 in the filtration vessel 230 in order to dissolve and remove the adsorbed compounds. The clean solid adsorbent stream 238, is recovered and recycled to the mixing vessel 210, a stream 236 of rejected materials is recovered, and spent adsorbent is discharged 234. A solvent-asphalt mixture 232 is withdrawn from the filtering vessel 230 and sent to a fractionator 240 to separate the solvent from the asphalt phase which is withdrawn as stream 242 for appropriate disposal. The clean aromatic and/or polar solvent is recovered as stream 244 and recycled to filtration vessel 230.

The recovered deasphalted oil and solvent stream from the first separation vessel 222 is introduced into a second separation vessel 250 maintained at an effective temperature and pressure to separate solvent from the deasphalted oil, such as between the solvent's boiling and critical temperature, under a pressure of between one and three bars. The solvent stream 252 is recovered and returned to the mixing vessel 210, in certain embodiments in a continuous operation. The deasphalted oil stream 254 is discharged from the bottom of the vessel 250.

In certain embodiments of the integrated process herein, and to maximize yield and minimize asphalt and/or resin in the system, one or more of the asphalt or other rejected compounds, such as those desorbed from adsorbent materials, can be recycled to the catalytic hydrogen-aquathermolysis reactor 36. For instance, this can include all or a portion of the rejected materials in stream 236 and/or all or a portion of the asphalt phase 242. This recycle can be charged as depicted in FIG. 1 with respect to stream 50. In further embodiments, a portion of the deasphalted upgraded oil 254 is recycled to the catalytic hydrogen-aquathermolysis reactor 36, directly or via mixing unit 14, mixing valve 22, and/or the charge heater 18, as all or a portion of the recycle stream 50.

Figure 5:
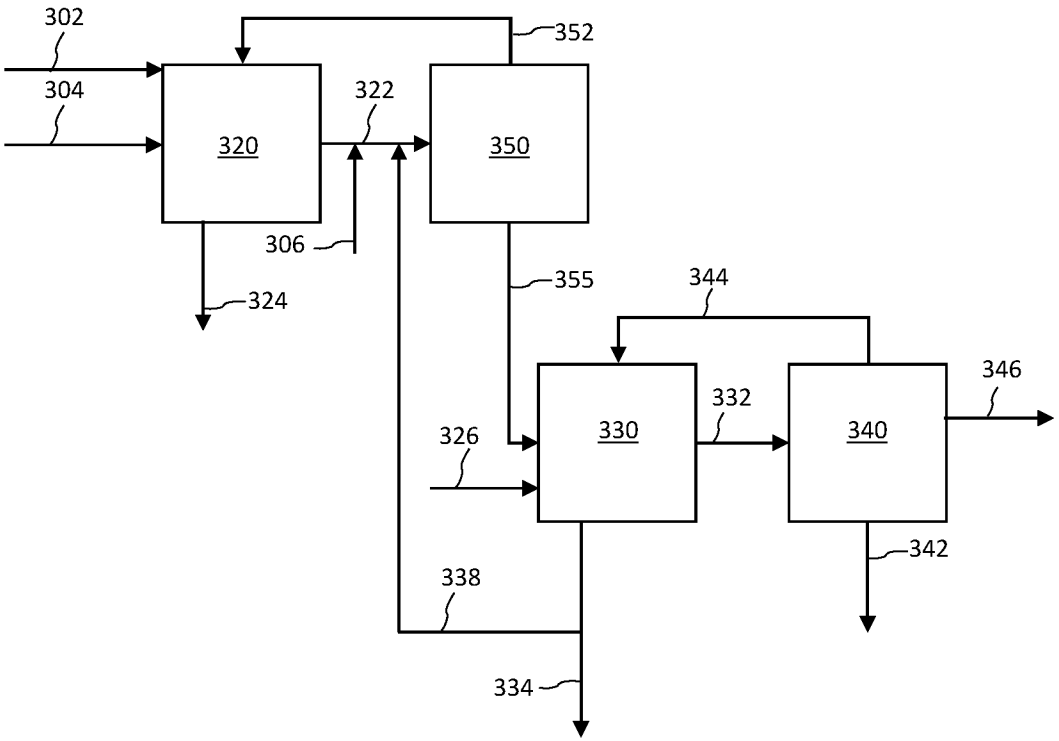
FIG. 5 is a process flow diagram of another embodiment of an adsorption-enhanced solvent deasphalting process effective to separate asphaltenes and in certain embodiments spent catalyst materials from the catalytic hydrogen aquathermolysis effluent.

FIG. 5 shows another embodiment of an enhanced solvent deasphalting process that that uses as a feedstream 302 all or a portion of the catalytic hydrogen-aquathermolysis reactor effluent, such as effluent 42, or the bottoms stream 48 (both described with respect to FIG. 1). In certain embodiments the feedstream 302 contains dispersed metal particles that were present in the feed to reactor 36 and are removed in the integrated adsorption system. In further embodiments, feedstream 302 can be heavy liquid products from a catalytic hydroprocessing unit, such as resid hydroprocessing; in these embodiments, dispersed metal particles that are contained in the heavy liquid products are removed in the enhanced solvent deasphalting zone. The dispersed metal particles from the catalyst concentrate in the heaviest unconverted oil fraction by the viscosity slump effect. The polarity of the catalytic metal particles induces their attraction to the heaviest fraction of the oil through polar-polar interactions. Metal particulates are encapsulated by the heavy polyaromatic condensed compounds and asphaltenes by a caging effect. Any metal particles remaining in the deasphalted oil can be separated, for instance, by electrostatic precipitation. In other embodiments, feedstream 302 can include or all or a portion of effluent of a process treating liquid products 42 from reactor 36 or the heavy portion 48, such as heavy liquid products from a delayed coking unit, whereby all or a portion of the dispersed metal particles have been removed with the coke removed from the coking unit.

The system shown with respect to FIG. 5 includes a first separation vessel 320, a second separation vessel 350, a filtration vessel 330, and fractionator 340. The feedstream 302 and a paraffinic solvent 304 are introduced into a first separation zone 320 in which asphalt is separated from the feedstream and discharged from the first separation zone 320 as stream 324. Conditions in the first separation vessel are maintained below the critical temperature and pressure of the solvent, as described above in the embodiment using solvent deasphalting in FIG. 2. In certain embodiments the solvent selected for use in the first separation vessel in the enhanced solvent deasphalting process herein is a C3 to C8 paraffinic solvent. A combined deasphalted oil and solvent stream 322 is discharged from the first separation zone 320 and mixed with an effective quantity of solid adsorbent material 306, for instance using an in-line mixing apparatus and/or a separate mixing zone, to produce a mixture of deasphalted oil, solvent, and solid adsorbent material, that is passed to the second separation zone 350. The mixture is maintained in the second separation zone 350 at an effective temperature and pressure to separate solvent from the deasphalted oil, such as between the solvent's boiling and critical temperature, under a pressure of between one and three bars. In addition, the mixture is maintained in the second separation zone 350 for a time sufficient to adsorb on the adsorbent material any remaining asphaltenes and/or sulfur-containing polynuclear aromatic molecules and/or nitrogen-containing polynuclear aromatic molecules. The solvent is then separated and recovered from the deasphalted oil and adsorbent material and recycled as stream 352 to the first separation zone 320.

A slurry 355 of deasphalted oil and adsorbent from the second separation vessel 350 is mixed with an aromatic and/or polar solvent stream 326 in a filtration vessel 330 to separate and clean the adsorbent material. The solvent stream 326 can be similar to that described with respect to the adsorption system described with respect to FIG. 3 above. The solvent stream 326 can include benzene, toluene, xylenes, tetrahydrofuran, methylene chloride. In certain embodiments, the deasphalted oil and adsorbent mixture 355 is washed with aromatic or polar solvent 326 in a solvent to feed ratio (weight to weight) of about 1:1-8:1, 1:1-6:1, or 1:1-3:1 in the filtration vessel 330 in order to dissolve and remove the adsorbed sulfur-containing and nitrogen-containing compounds. The clean solid adsorbent stream 338 is recovered and recycled for mixing with the deasphalted oil stream 322. Spent adsorbent material is discharged from the filtration vessel as stream 334. The deasphalted oil and solvent mixture 332 is passed from the filtration vessel 330 to the fractionator 340 to separate the solvent from a stream 342 of rejected materials for appropriate disposal. The clean aromatic and/or polar solvent is recovered as stream 344 and recycled to filtration vessel 330. The deasphalted oil is recovered as stream 346.

In certain embodiments of the integrated process herein, and to maximize yield and minimize asphalt and/or resin in the system, one or more of the asphalt or other rejected compounds, such as those desorbed from adsorbent materials, can be recycled to the catalytic hydrogen-aquathermolysis reactor 36. For instance, this can include or all or a portion of the asphalt phase 324 and/or all or a portion of the rejected materials in stream 342. This recycle can be charged as depicted in FIG. 1 with respect to stream 50. In further embodiments, a portion of the deasphalted upgraded oil 254 is recycled to the catalytic hydrogen-aquathermolysis reactor 36, directly or via mixing unit 14, mixing valve 22, and/or the charge heater 18, as all or a portion of the recycle stream 50.

Solid adsorbent materials or mixture of solid adsorbent materials for use in the embodiments of FIGS. 3-5 that are effective to capture the heavy large polyaromatic compounds and asphaltenes include those that are characterized by high surface area, large pore volumes, and a wide pore diameter distribution. Types of adsorbent materials that are effective for contacting all or a portion of the catalytic hydrogen-aquathermolysis effluent, directly or following one or more various downstream processes, include molecular sieves, silica gel, activated carbon, activated alumina, silica-alumina gel, zinc oxide, clays such as attapulgus clay, fresh zeolitic catalyst materials, used zeolitic catalyst materials, spent catalysts from other refining operations, and mixtures of two or more of these materials. Effective adsorbent materials are characterized by any suitable shape, such as granules, extrudates, tablets, spheres, pellets, or natural shapes, having average particle diameters in the range of from about 0.01-4.0, 0.1-4.0, or 0.2-4.0 millimeters, average pore diameters in the range of from 1-5000, 1-2000, 5-5000, 5-2000, 100-5000 or 100-2000 nanometers, pore volumes in the range of from about 0.08-1.2, 0.3-1.2, 0.5-1.2, 0.08-0.5, 0.1-0.5, or 0.3-0.5 cubic centimeters per gram, and a surface area of at least about 100 square meters per gram. The quantity (weight basis, feed to adsorbent) of the solid adsorbent material used in the embodiments herein is about 0.1:1-20:1, 0.1:1-10:1, 1:1-20:1, or 1:1-10:1.

In further embodiments, solid adsorbent material includes spent catalyst. In certain embodiments the spent catalyst can be obtained from any type of reactor that needs to be taken off-stream for catalyst removal due to loss of efficacy of at the end of the normal lifetime of the materials as catalytic materials, such as fixed-bed, continuous stirred tank (CSTR), or tubular reactors. In certain embodiments the spent catalyst can be obtained from any type of reactor that includes on-stream catalyst removal and replenishment, for example slurry-bed, ebullated-bed or moving-bed reactors. For example catalyst that is typically drawn for regeneration or replacement can be used as the solid adsorbent material in any of the embodiments herein that utilize source solid adsorbent material. In further embodiment, for instance when a membrane-wall type gasifier is integrated, overall process waste is significantly reduced by disposing of the spent solid catalyst materials rather than discard them as a waste material which incurs substantial expense and entails environmental considerations.

Advantageously, the present processes and systems combines low pressure operation, low cost highly dispersed catalytic particles, water, and low hydrogen requirement including the ability to utilize low hydrogen partial pressure off-gas streams, to thereby increase the heavy oils conversion and improve their asphaltene stability to reduce their aggregation, association, and eventual coke formation.

The present processes and systems enable economical upgrading of heavy petroleum oils, such as atmospheric and/or vacuum residues. In addition, the otherwise low value by-products can be utilized to generate valuable commodities, which in turn are useful as starting materials in the petrochemical industry, to generate energy or steam, or for use within the upgrading process. The present processes and systems enable a low hydrogen demand process that can utilize waste hydrogen stream from a refinery such as refinery fuel gas (RFG) system.

Using the catalytic hydrogen-aquathermolysis process herein, refiners can improve refining economics by minimizing the quantity of coke, asphaltenes, and wasted hydrogen. The dispersed catalytic particles can be derived from two, three or more metals, with injection of relatively low quantities of water and hydrogen. The net outcome is a reduction in hydrogen abstraction reactions that occur during the course of thermal cracking, and resulting in improved heavy oil conversion. The process herein is further complemented by an integrated of solvent deasphalting process.

The method and system of the present invention have been described above and in the attached drawings; however, modifications will be apparent to those of ordinary skill in the art and the scope of protection for the invention is to be defined by the claims that follow.

The invention claimed is:

1. A process for upgrading heavy oil integrating thermal cracking, hydrogenolysis, and catalytic aquathermolysis, the process comprising:

charging to a catalytic hydrogen-aquathermolysis reactor heavy oil feed, water in a quantity of about 1 to about 20 weight percent relative to the mass of the heavy oil feed, hydrogen in a quantity of about 1 to about 1000 normalized cubic meters of hydrogen to cubic meters of heavy oil feed, viscosity reducing agent in a quantity of 10 to about 40 weight percent relative to the mass of the heavy oil feed, and catalytic materials in a quantity of about 100 to 20,000 parts per million active catalyst particles on a weight basis relative to the mass of the heavy oil feed;

operating the catalytic hydrogen-aquathermolysis reactor at a hydrogen pressure of no more than about 60 bars of hydrogen partial pressure, a temperature of at least about 400° C. and a liquid hourly space velocity on a fresh feed basis relative to the reactor volume of at least 0.1 $h^{-1}$, discharging from the catalytic hydrogen-aquathermolysis reactor a mixed gas and liquid reactor effluents, passing the mixed gas and liquid reactor effluents to a vapor-liquid separator to separate light effluents from upgraded heavy oil effluents, wherein the upgraded heavy oil effluents have a stability P-Value of at least about 1.2.

2. The process as in claim 1 wherein the heavy oil feed comprises vacuum residue, atmospheric residue or a combination of vacuum residue and atmospheric residue.

3. The process of claim 2 wherein the heavy oil feed further comprises effluent from one or more of a downstream fractionator unit, a solvent deasphalting unit, a delayed coking unit, a gasification unit, or a catalytic hydroprocessing unit.

4. The process as in claim 1, further comprising:

prior to charging to the reactor, mixing the heavy oil feed, catalytic particles and viscosity reducing agent to produce a first mixture at a temperature of 40-80° C. at a pressure the range of about 1-30 bars;

pre-heating the first mixture to a reaction temperature in the range of from about 400° C. to 500° C.;

mixing the pre-heated first mixture with hydrogen and water to provide a second mixture, and charging the second mixture to the reactor.

5. The process as in claim 4, wherein production and pre-heating of the first mixture occurs in the absence of added hydrogen.

6. The process as in claim 4, wherein catalytic material is provided in the form of particles that decompose during the pre-heating step to form active catalyst particles.

7. The process as in claim 4, wherein catalytic material is provided in the form of catalytic metals precursors that form active catalyst particles during the pre-heating step.

8. The process as in claim 1, further comprising:

prior to charging to the reactor, mixing the heavy oil feed, catalytic particles and viscosity reducing agent to produce a first mixture at a temperature of at most 100° C.;

pre-heating the first mixture to a temperature below a reaction temperature;

mixing the pre-heated first mixture with hydrogen and water to provide a second mixture, and charging the second mixture to the reactor, wherein the second mixture is heated to the reaction temperature in the range of from about 400° C. to 500° C. in the reactor.

9. The process as in claim 8, wherein production and pre-heating of the first mixture occurs in the absence of added hydrogen.

10. The process as in claim 8, wherein catalytic material is provided in the form of particles that decompose during the pre-heating step to form active catalyst particles.

11. The process as in claim 8, wherein catalytic material is provided in the form of catalytic metals precursors that form active catalyst particles during the pre-heating step.

12. The process as in claim 1, further comprising:

prior to charging to the reactor, mixing the heavy oil feed, catalytic particles and viscosity reducing agent to produce a first mixture at a temperature of at most 100° C.;

pre-heating the first mixture to a temperature below a reaction temperature;

mixing the pre-heated first mixture with hydrogen and water to provide a second mixture, pre-heating the second mixture to a reaction temperature in the range of from about 400° C. to 500° C. upstream of the reactor; and charging the pre-heated second mixture to the reactor.

13. The process as in claim 12, wherein production and pre-heating of the first mixture occurs in the absence of added hydrogen.

14. The process as in claim 13, wherein during the step of pre-heating the first mixture catalytic material is converted to active catalyst particles.

15. The process as in claim 14, wherein catalytic material is provided in the form of catalyst particles that decompose during the first pre-heating step to form active catalyst particles.

16. The process as in claim 14, wherein catalytic material is provided in the form of catalytic metals precursors that form active catalyst particles during the first pre-heating step.

17. The process as in claim 1, wherein catalytic material is provided in the form of active catalyst particles.

18. The process as in claim 1, further comprising recycling at least a portion of the light effluents back to the reactor.

19. The process as in claim 1, wherein the reactor operates at a hydrogen partial pressure (bar) of 5-60;

a temperature (° C.) of 400-500; and a liquid hourly space velocity ($h^{-1}$), on a fresh feed basis relative to the catalysts, in the range of 0.1-20.

20. The process as in claim 1, further comprising passing the upgraded heavy oil effluents to a separation zone to recover hydrocarbon products and bottoms, and optionally recycling bottoms to the reactor.

21. The process as in claim 20, further comprising passing bottoms and C3 to C8 light paraffins at a solvent-to-bottoms ratio (weight to weight) is in the range of about 2:1-10:1 to a solvent deasphalting unit to separate a deasphalted oil phase and an asphalt phase, recovering deasphalted upgraded oil as the deasphalted oil phase;

discharging as the asphalt phase asphalt and catalyst particles; and optionally recycling all or a portion of the asphalt phase including catalyst particles to the catalytic hydrogen-aquathermolysis reactor.

22. The process as in claim 20, comprising mixing bottoms with paraffinic solvent and an effective quantity of solid adsorbent material, at a temperature and pressure that are below the critical pressure and temperature of the solvent to promote solvent-flocculation of solid asphaltenes, and for a time sufficient to adsorb on the solid adsorbent material sulfur-containing and nitrogen-containing polynuclear aromatic molecules that are contained in the upgraded heavy oil effluents, to form a mixture;

passing the mixture to a first separation vessel;

separating a solid phase comprising asphaltenes and solid adsorbent material from a liquid phase comprising deasphalted oil and paraffinic solvent;

passing the solid phase to a filtration vessel with an aromatic and/or polar solvent to desorb the adsorbed contaminants and to recover regenerated solid adsorbent material; and passing the liquid phase to a second separation vessel to separate deasphalted oil and paraffinic solvent, and optionally recycling at least a portion of the separated paraffinic solvent to the step of mixing bottoms with paraffinic solvent and an effective quantity of solid adsorbent material.

23. The process as in claim 20, comprising mixing the bottoms and paraffinic solvent in a first separation vessel at a temperature and pressure that are below the critical pressure and temperature of the paraffinic solvent to promote solvent-flocculation of solid asphaltenes;

discharging an asphalt stream from the first separation vessel;

passing a mixed deasphalted oil and paraffinic solvent stream from the first separation vessel, and an effective quantity of solid adsorbent material, to a second separation vessel;

maintaining the mixture in the second separation vessel for a time sufficient for adsorption by the solid adsorbent material of asphaltenes and/or sulfur-containing polynuclear aromatic molecules and/or nitrogen-containing polynuclear aromatic molecules remaining in the deasphalted oil;

separating and recovering at least a portion of the paraffinic solvent from the deasphalted oil and adsorbent material;

passing deasphalted oil and solid adsorbent material from the second separation vessel to a filtration vessel with an aromatic and/or polar solvent to desorb the adsorbed contaminants and to recover regenerated solid adsorbent material; and passing the deasphalted oil and aromatic and/or polar solvent mixture to a fractionator to recover the aromatic and/or polar solvent, and deasphalted oil.

24. The process as in claim 1, further comprising passing the upgraded heavy oil effluents and an effective quantity of C3 to C8 light paraffins at a solvent-to-bottoms ratio (weight to weight) is in the range of about 2:1-10:1 to a solvent deasphalting unit to separate a deasphalted oil phase and an asphalt phase, recovering deasphalted upgraded oil as the deasphalted oil phase;

discharging as the asphalt phase asphalt and catalyst particles, and optionally recycling all or a portion of the asphalt phase including catalyst particles to the catalytic hydrogen-aquathermolysis reactor.

25. The process as in claim 1, comprising mixing the upgraded heavy oil effluents with paraffinic solvent and an effective quantity of solid adsorbent material, at a temperature and pressure that are below the critical pressure and temperature of the solvent to promote solvent-flocculation of solid asphaltenes, and for a time sufficient to adsorb on the solid adsorbent material sulfur-containing and nitrogen-containing polynuclear aromatic molecules that are contained in the upgraded heavy oil effluents, to form a mixture;

passing the mixture to a first separation vessel;

separating a solid phase comprising asphaltenes and solid adsorbent material from a liquid phase comprising deasphalted oil and paraffinic solvent;

passing the solid phase to a filtration vessel with an aromatic and/or polar solvent to desorb the adsorbed contaminants and to recover regenerated solid adsorbent material; and passing the liquid phase to a second separation vessel to separate deasphalted oil and paraffinic solvent, and optionally recycling at least a portion of the separated paraffinic solvent to the step of mixing reactor effluents with paraffinic solvent and an effective quantity of solid adsorbent material.

26. The process as in claim 1, comprising mixing the upgraded heavy oil effluents and paraffinic solvent in a first separation vessel at a temperature and pressure that are below the critical pressure and temperature of the paraffinic solvent to promote solvent-flocculation of solid asphaltenes;

discharging an asphalt stream from the first separation vessel;

passing a mixed deasphalted oil and paraffinic solvent stream from the first separation vessel, and an effective quantity of solid adsorbent material, to a second separation vessel;

maintaining the mixture in the second separation vessel for a time sufficient for adsorption by the solid adsorbent material of asphaltenes and/or sulfur-containing polynuclear aromatic molecules and/or nitrogen-containing polynuclear aromatic molecules remaining in the deasphalted oil;

separating and recovering at least a portion of the paraffinic solvent from the deasphalted oil and adsorbent material;

passing deasphalted oil and solid adsorbent material from the second separation vessel to a filtration vessel with an aromatic and/or polar solvent to desorb the adsorbed contaminants and to recover regenerated solid adsorbent material; and passing the deasphalted oil and aromatic and/or polar solvent mixture to a fractionator to recover the aromatic and/or polar solvent, and deasphalted oil.

* * * * *